US006062648A

United States Patent [19]

Adler

[11] Patent Number: 6,062,648

[45] Date of Patent: May 16, 2000

[54] FOLDABLE LOUNGE CHAIR

[76] Inventor: Jolie Adler, 11626 Countryview La., Boca Raton, Fla. 33428

[21] Appl. No.: 09/233,022

[22] Filed: Jan. 20, 1999

Related U.S. Application Data

[60] Provisional application No. 60/071,855, Jan. 20, 1998.

[51] Int. Cl.[7] ..... A47C 7/00; A47C 4/00

[52] U.S. Cl. ..... 297/440.24; 297/42; 297/44; 297/45

[58] Field of Search ..... 297/440.24, 42, 297/44, 45; 135/74

[56] References Cited

U.S. PATENT DOCUMENTS

| | | | |
|---|---|---|---|
| 2,764,225 | 9/1956 | Sharpe . | |
| 3,669,133 | 6/1972 | Hyman | 135/74 |
| 3,708,204 | 1/1973 | Wachsmann | 297/440.24 |
| 4,359,244 | 11/1982 | Koehm . | |
| 4,421,356 | 12/1983 | Singer | 297/440.24 X |
| 4,487,345 | 12/1984 | Pierce et al. . | |
| 4,715,650 | 12/1987 | Berman et al. . | |
| 4,775,182 | 10/1988 | von Hoffman . | |
| 4,824,171 | 4/1989 | Hollingsworth . | |
| 5,058,950 | 10/1991 | Mann . | |

*Primary Examiner*—Anthony D. Barfield

[57] ABSTRACT

A flexible foldable beach chair having a string-bar-connector assembly which allows the chair to collapse into a compact package. The string-bar-connector assembly is insertably or pivotally attached to two back-side bars on left and right, front and rear bottom ends of the chair. The back side bars includes a back-rest including reclining linkages and a pivotally connected seat support structure with including reclining adjustability. The seat and back-rest are made of a durable nylon weave fabric, which is impervious to water and sand debris. The assembly include stoppers or plugs attached within all the bars for constraining the durable and flexible string of the assembly, and for preventing accumulation of foreign material within the bars. Notches are formed within a side surface of the rear legs for various levels of adjustability. The foldable beach chair is lightweight, compact and portable.

9 Claims, 8 Drawing Sheets

FOLDABLE LOUNGE CHAIR

CROSS-REFERENCE TO RELATED APPLICATION

This application claims the benefit of U.S. Provisional Patent Application Ser. No. 60/071,855, filed Jan. 20, 1998.

BACKGROUND OF THE INVENTION

1. Field of the Invention

The present invention relates generally to a foldable chair. More specifically, the invention relates to a foldable beach chair, made of durable and flexible material, which collapses into a compact and light-weight portable chair.

2. Description of Related Art

Various foldable chairs have been devised which are portable and relatively compact. However, the problem with most conventional foldable chairs is that most are bulky or heavy and require an inordinate amount of effort to manipulate. The more lighter weight chairs, among the conventional foldable chairs, are naturally prone to structural limitations which prevent efficient and compact foldability, due to elements such as hinges, plastic ligaments, sleeves, etc. These elements usually deteriorate over time from rust, bending or repeated use, and provide a fear of structural instability within the mind of a respective user.

Other problems related to the conventional foldable chairs include the replacement of such elements as hinges, plastic ligaments, etc., which are usually difficult to find or unreasonably priced in the market place. A user of the conventional foldable chair is often left with the only reasonable option of disposing of an otherwise mint condition foldable chair. The foldable beach chair of the instant invention is lightweight and durable and does not suffer from the aforementioned structural limitations due to its unique way of collapsing which endows the foldable chair of the present invention with a unique compactness.

U.S. Pat. No. 2,764,225 issued to J. M. Sharpe discloses a collapsible piece of furniture which resembles a structural frame for a sofa. The back portion of the frame folds in a clockwise fashion and lay in a stacked configuration upon the seat portion. The arm rest portions are subsequently stacked thereon, following the removal of bolts and clamped connections at strategic support points. The resulting collapsible structure is rather long and bulky, however, and makes carrying quite difficult.

U.S. Pat. No. 4,359,244 issued to Koehm discloses a folding chair which includes a triangular shaped seat support structure with couplings. The couplings are used to retain the legs of the triangular structure by pin or rivet connections. The foldable beach chair of the instant invention folds without the need of rivets or similar connections.

U.S. Pat. No. 4,487,345 issued to Pierce et al. discloses a backpack chair provided with shoulder straps and a back rest. The chair is a conventional folding chair wherein the frame is formed of a series of interconnected sub frames which unfold in a manner which is quite cumbersome. U.S. Pat. No. 4,715,650 issued to Berman et al. discloses a fully collapsible portable lawn chair with similar foldable features of the instant invention. The chair employs sleeve-locked, flexible, "living" hinges intermediate certain straight members of the frame. This arrangement supposedly allows a second level of compacting. However, hinges, particularly plastic hinges, limit the degree of foldability and suffer fatigue as a result of repeated use. The sleeve covers the "living" hinge to produce a rigid support in the frame; but, sleeves usually have a tendency to slip and are cause for structural instability.

U.S. Pat. No. 4,824,171 issued to Hollingsworth discloses a collapsible beach chair which is formed from a covering or mat, such as canvas. The chair is composed of four seat compartments which are attached at the seams in a cross pattern to create a dual seat and back portion. Adjustable straps are attached at the top and bottom sides of the respective seat and back portions for reclining. The seat folds in a way that one would fold a sheet of paper into four equal parts. When completely folded the chair is adapted to be carried in the form of a suit case. The structural features of this particular chair are lacking compared to the instant invention in that structural rigidity is not of particular significance.

U.S. Pat. No. 4,775,182 issued to von Hoffman teaches a foldable chair with limited reclinable features. The chair sits on four studded rods having a seat portion and a back portion with back supporting left and right rods. The back portion is opened to a fixed angle, which is constrained by chain links. The links are attached at points on the respective left and right rods of the respective back and seat portions. The back portion folds in a clockwise fashion and is readily folded into an elongated configuration of narrow width via a back structural linkage system. The mode of operation is completely different to that of the instant invention.

U.S. Pat. No. 5,058,950 issued to Mann is similar to that of von Hoffman in that the mode of operation is completely different from that of the instant invention. A few variations reside in the fact that the foldable chair of Mann collapses inward and upward at the arm rests and folds inward and upward at the mid-point of the seat creating a compact structure. While there are many variations of foldable chairs cited in the above references, none of the references teach the design features of the invention as herein described.

The foldable beach chair of the instant invention is different in that it comprises a collapsible string-bar-connector assembly for reducing an otherwise rigid chair structure into a compact and light-weight foldable chair. This feature is neither taught nor suggested by the prior or related art. Thus, none of the above inventions and patents, taken either singly or in combination, is seen to describe the instant invention as claimed.

SUMMARY OF THE INVENTION

Accordingly, it is a principal object of the invention to provide a foldable beach chair which collapses to a compact structure for ease of carrying and efficient storing.

It is another object of the invention to provide a foldable beach chair which is easily foldable and light-weight.

It is a further object of the invention to provide a foldable beach chair that is comfortable and allows for adjustability from upright sitting to various reclining positions.

Still another object of the invention is to provide improved elements and arrangements thereof in the foldable beach chair for the purposes described which is inexpensive, dependable and fully effective in accomplishing its intended purposes.

The invention described herein is a foldable beach chair having a seat and a backrest, wherein the frame structure of the chair is made of a flexible material. The chair comprises a unique foldable assembly that includes a string-bar-connector assembly in combination with a pivotally attached assembly. The string-bar-connector assembly is insertably or pivotally attached to two back side bars on left and right ends of the respective bars. The assembly also include stoppers or plugs attached within the left and right back bars at the side top surfaces for constraining the durable and flexible string from the left and right end.

Similar connections of the assembly are made at the bottom front and back portions of the chair. This arrangement supports a flexible backrest and seat support made from a material fabric such as a nylon weave.

The backrest can be adjusted from an up and sitting position to various reclining positions, via a durable reclining linkage secured to the left and right bars. The linkages have uniformly spaced notches that are preferably disposed on a portion of the rear legs of the chair. The top bar of the backrest, the front legs, which also form the armrests, and the rear legs are adapted to be foldable in half.

The chair is folded by forwardly collapsing the back support on to the seat support. The bars from the unique connection assembly are removed from the connectors which cause the left and right sides at the top and base of the chair to fold or collapse inwardly, forming a compact and convenient package for easy transport. The front and rear leg portions are made to fold in half by means of pivots and removable recessed connections.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to a foldable beach chair. Preferred embodiments of the present invention are depicted in FIGS. 1–8 and the assembled beach chair is generally referenced by numeral 5.

Figure 1:
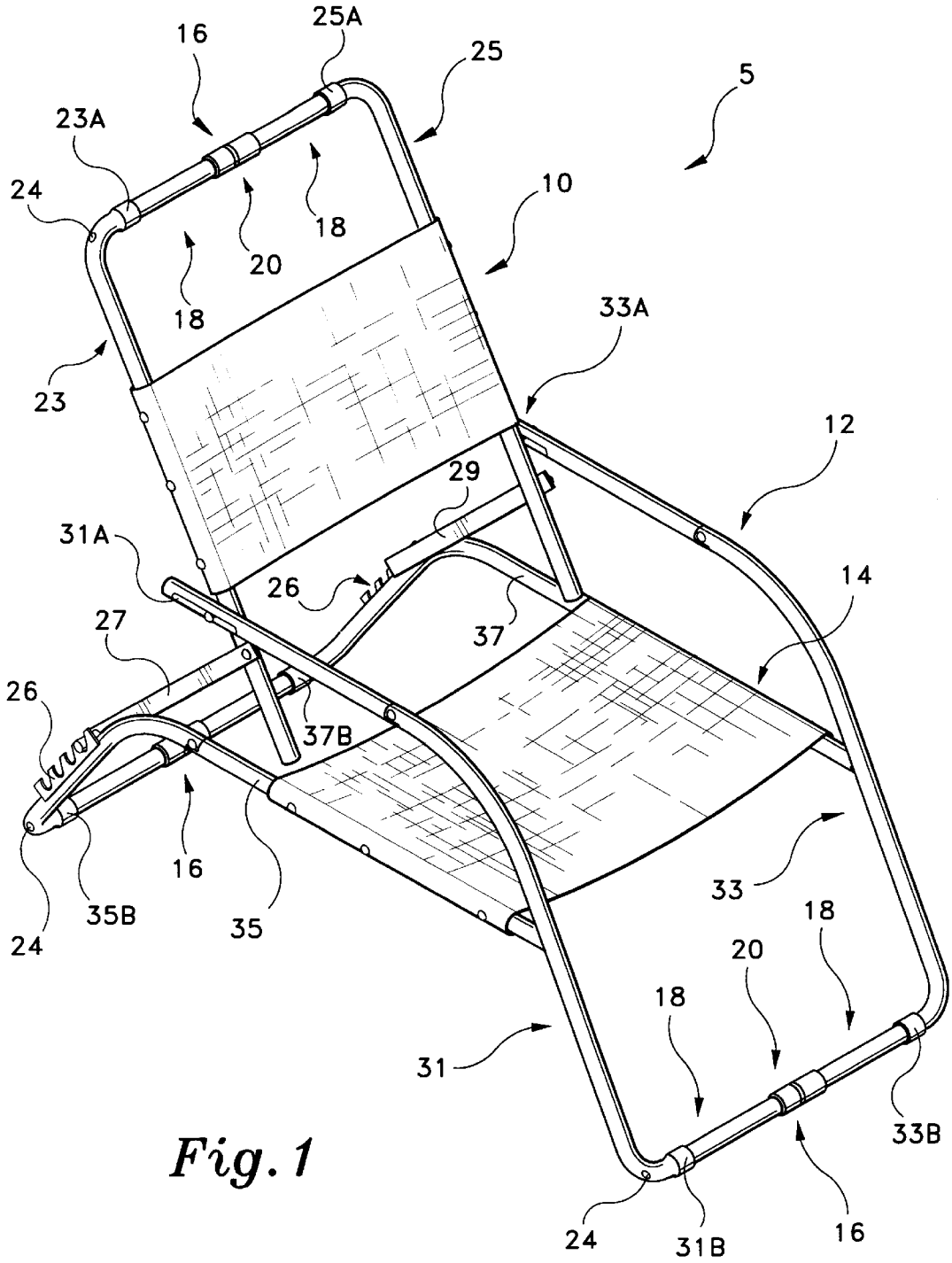
FIG. 1 is a perspective view of the foldable beach chair according to the invention.

As best seen in FIG. 1, the flexible, foldable, beach chair includes a backrest portion 10, an armrest portion 12, a seat portion 14 and a string-bar-connector assembly 16. The assembly comprises left and right cylindrically shaped hollow bars 18 of equal dimensions, a cylindrical connector 20 with left and right flared diameters for insertably attaching the cylindrically shaped bars. The connector 20, also includes a hole for inserting a flexible string 22 therethrough.

Figure 2A:
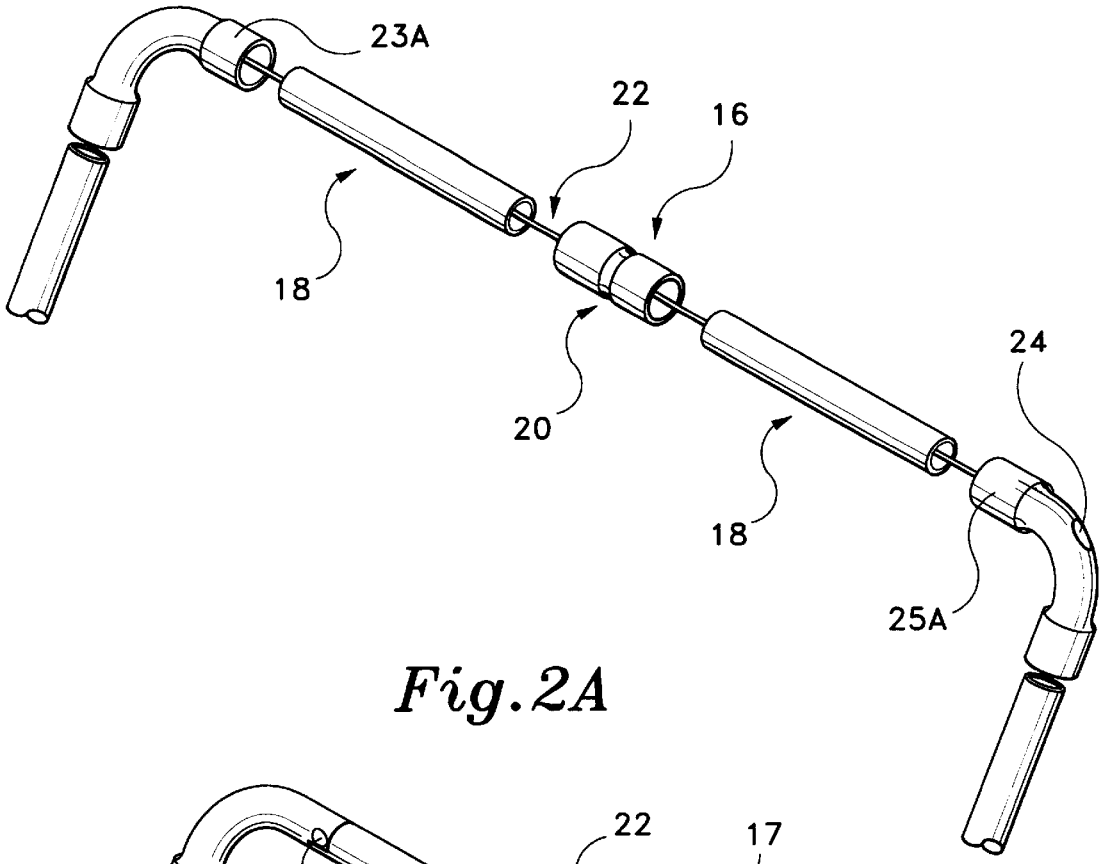
FIG. 2A is a fragmented, partially exploded, perspective view of the collapsible string-bar-connector assembly according to the invention.

As diagrammatically illustrated in FIG. 2A, the string 22 of the assembly constrains the left and right bars 18 and connector 20 as a single unit. The string 22 is a heavy duty elastic material which runs through the hole of the connector 20 and the hollow bars 18 with attachment to plugs or stoppers 24 at each end of the chair 5.

The connector 20, bars 18 and other structural features are made of a durable thermoplastic material, preferably PVC (polyvinyl chloride). However, any similar material can be used by one of ordinary skill in the art to fulfill the same intended purpose.

Figure 2B:
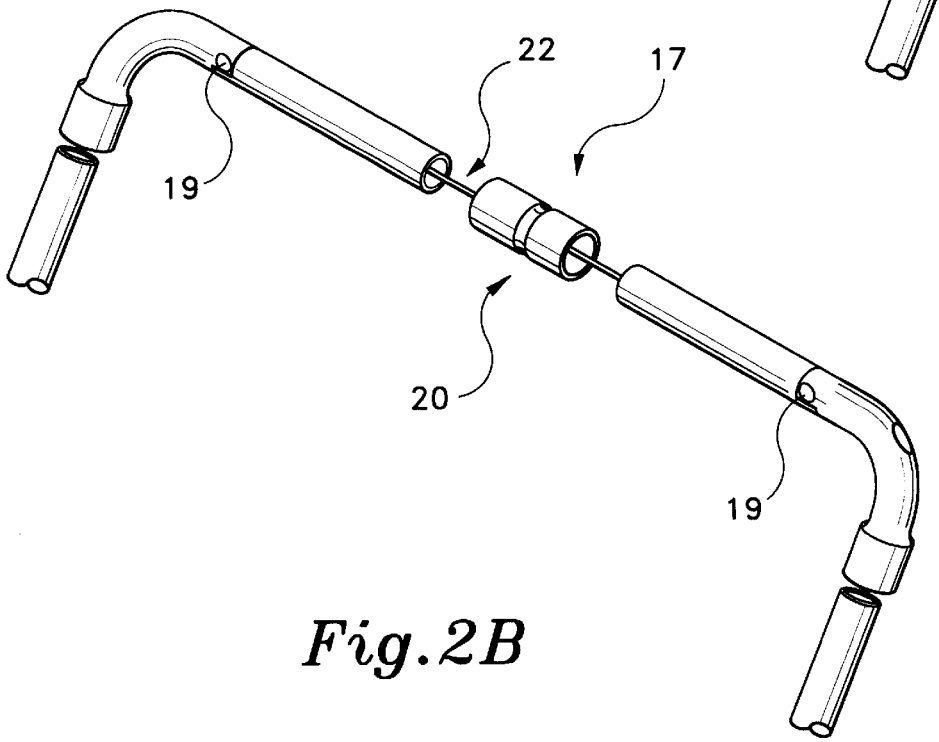
FIG. 2B is a fragmented, partially exploded, perspective view of an alternate design of the collapsible string-bar-connector assembly according to the invention.

FIG. 2B shows an alternate embodiment of the attachment of the string-bar-connector assembly 17, which is pivotally attached by a pivot connector 19, well known in the art, at one end rather than insertably attached as diagrammatically illustrated in FIG. 2A. Other alternate arrangements can be used in the instant invention such as recessed insertable bars in place of flared insertable ends. Such alternative arrangements are well within the knowledge of the skilled artisan.

The backrest portion 10 shown in FIG. 1, has left and right inverted L-shaped backrest bars 23,25 with respective left and right reclining linkages 27,29. The bars 23,25 have top and bottom ends. The bars 23,25 consists of a longitudinal portion 23*b*,25*b* and a corner connector 23*a*,25*a*. The corner connectors 23*a*,25*a* are open-ended, with flared diameters, and serve as insertable corner connector ends. Each of the top ends of the back-rest 23*a*,25*a* faces toward each other to accept the string-bar-connector assembly therebetween as diagrammatically illustrated in FIG. 2A or alternatively in FIG. 2B.

Each top end further includes another end or corner end defined by a hole for a plug 24, however, not all plugs are external. A plug (not shown) can be internally connected or disposed, in fact, some connectors do not require plugs because the string is knotted to an opening (not shown) inside the connector. The hole for the plug 24 has a diameter smaller than the flared diameters of the top ends, but each hole is substantially concentric. This arrangement allows for proper alignment and, most significantly, generous play between the elements of the assembly along the string to permit compact foldability. The bottom ends of the backrest have inserted stoppers made of thermoplastic material to prevent the entry of foreign material or to secure personal items such as pens, pencils, money, etc. All other open ended bars are sealed by stoppers to prevent the entry of foreign material.

The armrest portion 12, in FIG. 1 is comprised of left and right arcuate-L-shaped sections 31,33. Each of the sections have top and bottom ends, 31*a*,31*b* and 33*a*,33*b*, respectively. The top ends 31*a*,33*a* of the armrests are pivotally or slidably fixed to a bottom portion of the respective left and right inverted L-shaped backrest bars 23,25. The bottom ends 31*b*,33*b* of the armrest portion 12 are open-ended with flared diameters as insertable corner connector ends. Each of said insertable ends faces inward with respect to a perpendicular defined between the ends, which receives the string-bar-connector assembly as diagrammatically illustrated in FIGS. 2A or 2B. The insertable ends of the armrest, includes another end defined by a hole for a plug 24. The hole of the respective plugs 24 have a diameter smaller than the flared diameters, but substantially concentric therewith as similarly recited above.

The seat portion 14, in FIG. 1, is comprised of left and right arcuate-shaped-L sections 35,37 with notches 26. Each of the sections have top and bottom ends 35*a*,35*b* and 37*a*,37*b*, respectively. The top ends of the seat portion 14 are insertably attached or alternatively bolted or pivotally connected to a bottom-front-rear portion of the respective left and right arcuate-L-shaped sections of the armrest (not shown).

Figure 3:
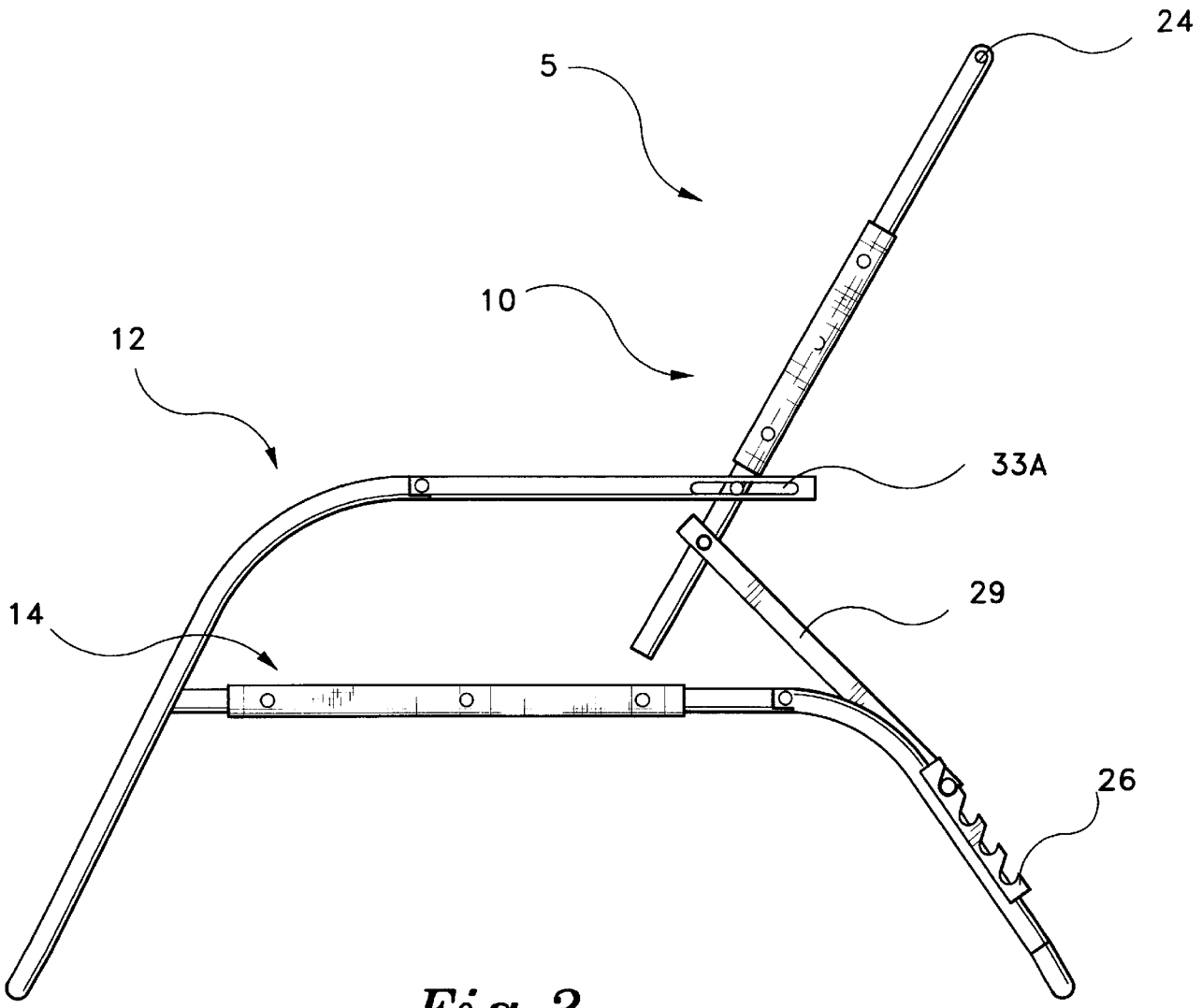
FIG. 3 is a side view of FIG. 1 illustrating the reclining features and notches for adjustability.

Various means are known by the skilled artisan for interconnecting structural bar members; elements such as recessed thermoplastic connectors are known in the relevant art for connecting elements as in the instant invention (i.e. method of insertion). Such elements also include features such as insertable connectors with spring loaded stems for releasably removing interconnected members as desired. This is one of many techniques available to one of ordinary skill in the art for interconnecting structural bar elements. Certainly other connecting means can be used so long as they provide the intended purpose as recited above. As for the notches 26, an exemplary embodiment is shown in FIGS. 1 and 3. The preferred notches of the instant invention include reclinable linkages 27 and 29 which are fixedly and slidably attached to the notches (not shown) for securing the linkages to the notch structure without the fear of the linkages slipping or being disconnected from the notches.

The bottom ends 35*b*,37*b* of the seat portion are open-ended with flared diameters which serve as insertable corner connector ends. Each of the insertable ends faces inward and toward each other for receiving the string-bar connector assembly illustrated in FIG. 2A or as alternatively illustrated in FIG. 2B. The insertable ends of a seat portion 14 includes another end defined by a hole for a plug 24 similar to those recited above. The hole of the plug 24 has a diameter smaller than the flared diameters, but substantially concentric therewith. Notches 26 are formed along the rear surface of the left and right arcuate-L-shaped sections 35,37 of the seat portion for receiving the respective reclining linkages 27,29. The string-bar-connector assembly as illustrated in FIG. 2A at least is insertably attached between the left and right sections of the respective backrest, front legs, and back legs, wherein the string 22 is attached to and constrained by the plugs 24.

FIG. 3, diagrammatically illustrates the reclinable features of the instant invention, wherein the linkages are inserted in the top notch for a certain level of reclining comfort. The armrest can be fixed or slidably fixed to the backrest to provide an added dimension of comfort.

Figure 4:
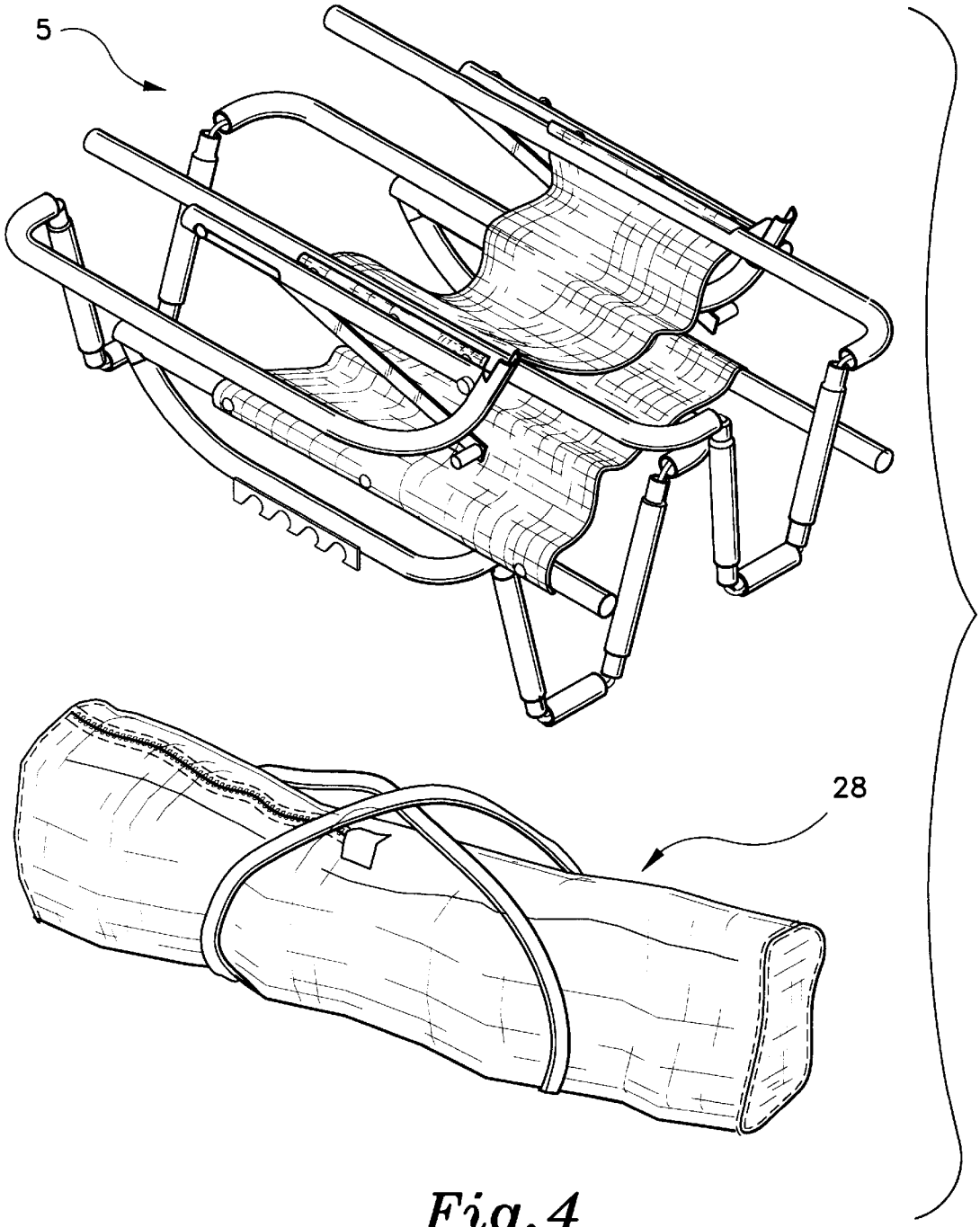
FIG. 4 is a perspective view of the foldable chair in a compact or storage configuration with associated storage bag.

FIG. 4, diagrammatically illustrates the foldable beach chair of the instant invention in a folded and compact form for storage or transport. The chair can be stored within a personal carrying bag 28, and can include special ornamental designs, initials, etc. Similar designs can also be include for the seat and backrest fabric, further including various means of attachment to the bars (e.g. pivots, buttons, velcro, etc.).

As shown in FIG. 4, the structure of the foldable chair can include additional recessed insertable connections within the structure at strategic points for alternate methods of folding the beach chair in various compact configurations for transport.

Figure 5:
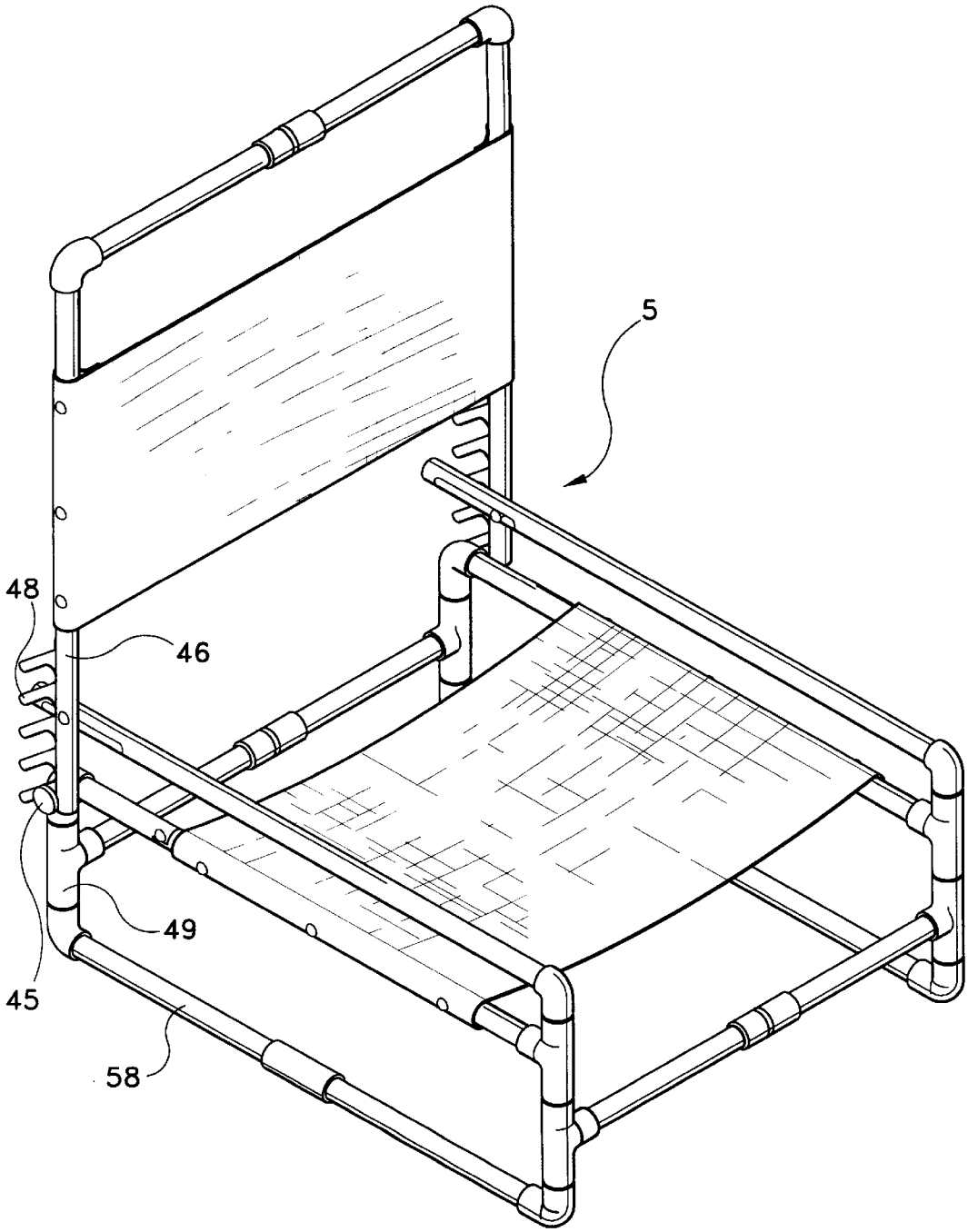
FIG. 5 is a perspective view of an alternate embodiment of the foldable chair according to the invention.
Figure 6:
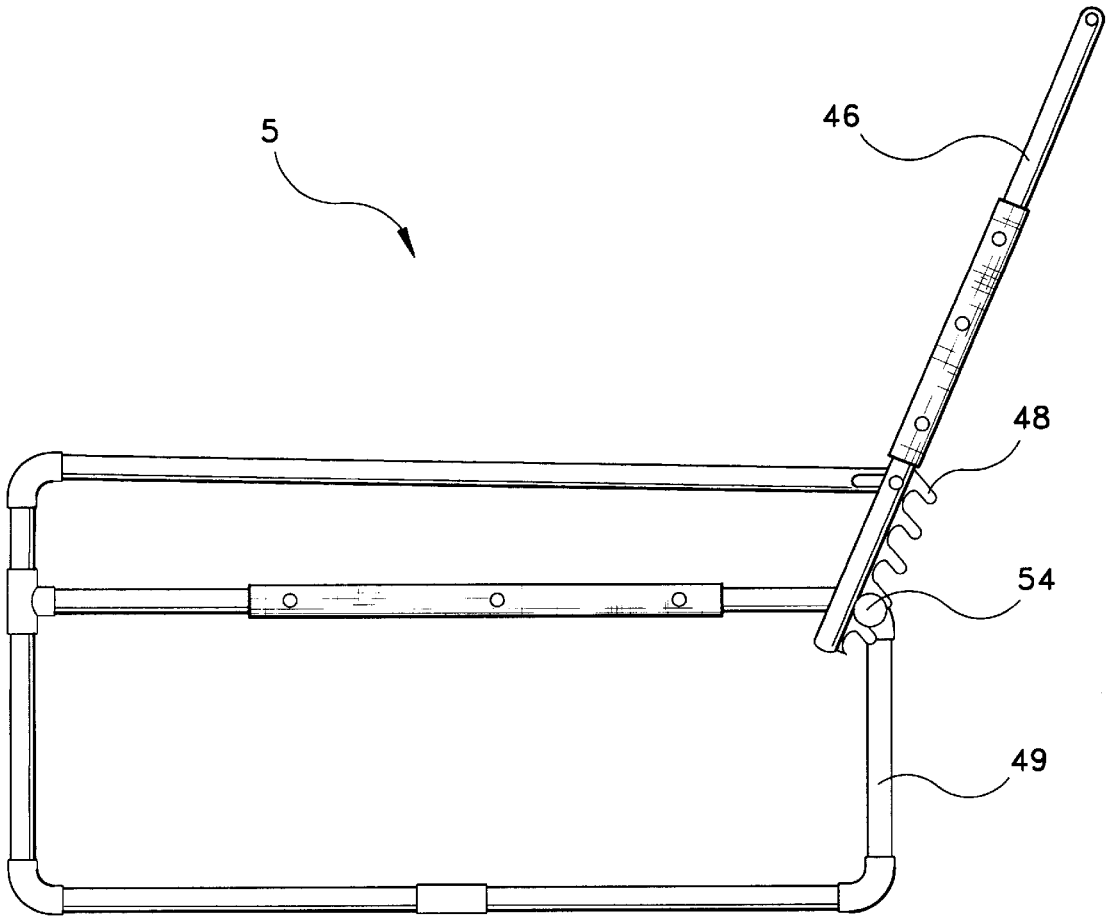
FIG. 6 is a side view of the alternate embodiment of the foldable chair according to the invention.

FIG. 5 shows a perspective view of an alternate embodiment of the foldable chair wherein both the back legs 49 and the front legs 53 are vertical and the backrest 46 is reclinable. In the embodiment depicted in FIG. 5, a laterally disposed protuberance 54 on each back leg 49 engages one of several laterally disposed notches 48 attached to each side of the backrest 46 and locks the reclinable backrest 46 into place. The notches 48 are bolted to the backrest 46, however, other suitable connecting means can be used. The orientation and location of the notches 48 and the location of the protuberance 54 are determined by which orientation and locations provide the best structural support and stability for a particular embodiment of the foldable chair 5. In addition, multiple protuberances can be used. Two laterally disposed support bars 58 stabilize the base of the chair 5. In FIG. 5, the backrest 46 is shown in the upright position, while in FIG. 6 which shows a side view of the alternate embodiment depicted in FIG. 5, the backrest 46 is shown in a reclined position.

Figures 7A, 7B:
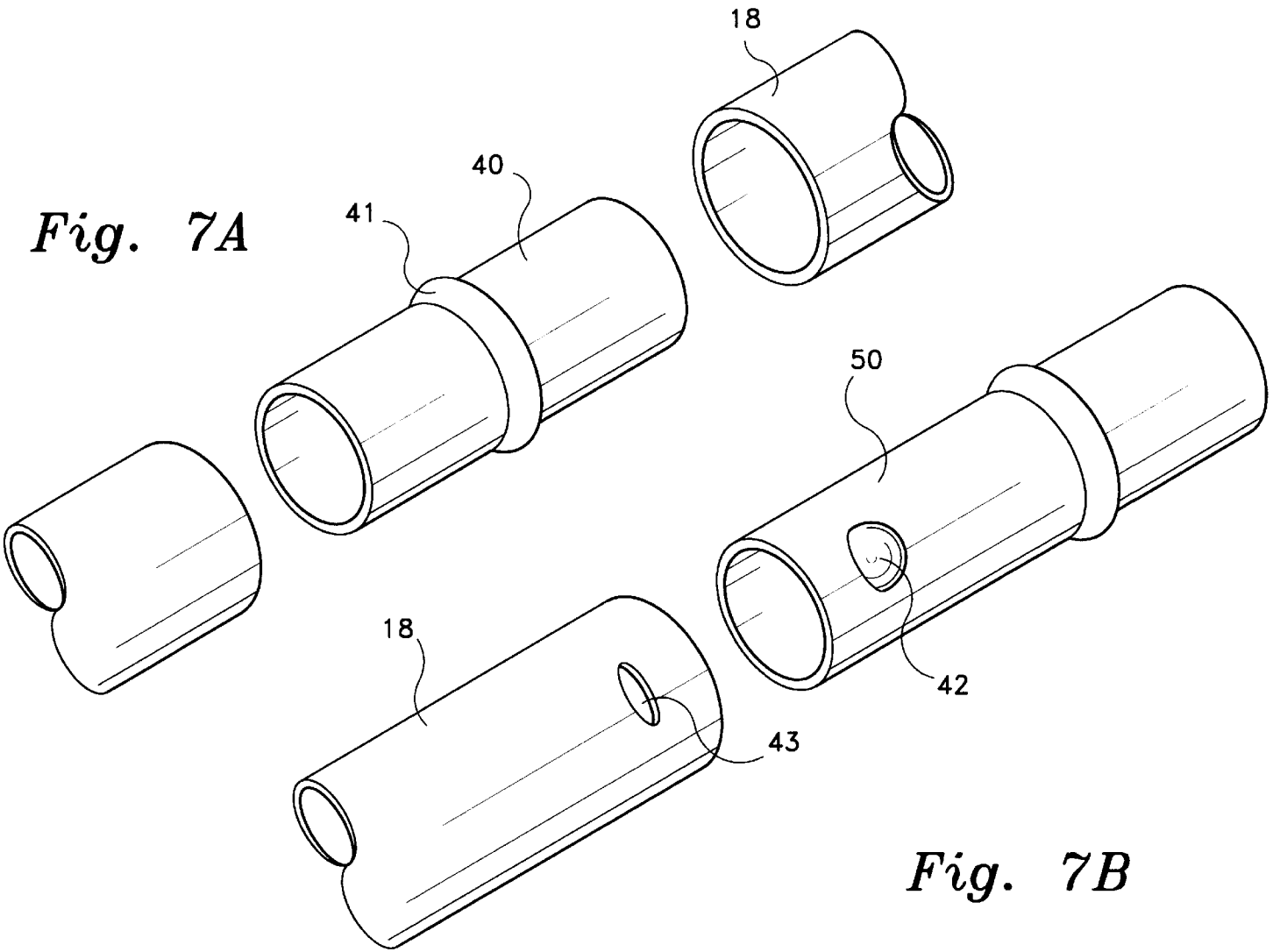
FIG. 7A is a partially fragmented, perspective view of elongated hollow tubes and a connecting center hollow tube according to the present invention.
FIG. 7B is a partially fragmented, perspective view of locking connecting pieces according to the present invention.

FIGS. 7A and 7B show alternate embodiments of how the string-bar-connector assembly can be connected. In FIG. 7A, the connector 40 fits inside the longitudinal bar 18. The connector 40 is inserted into the bar 18 until the bar 18 encounters a medially disposed ridge 41 on the connector 40. FIG. 7B shows a locking string-bar-connector assembly. The connector 50 shown in FIG. 7B has a bump or protuberance 42. The string-bar-connector assembly is locked in place when the protuberance 42 of the connector 50 is inserted into the hole 43 of the bar 18.

Figure 8C:
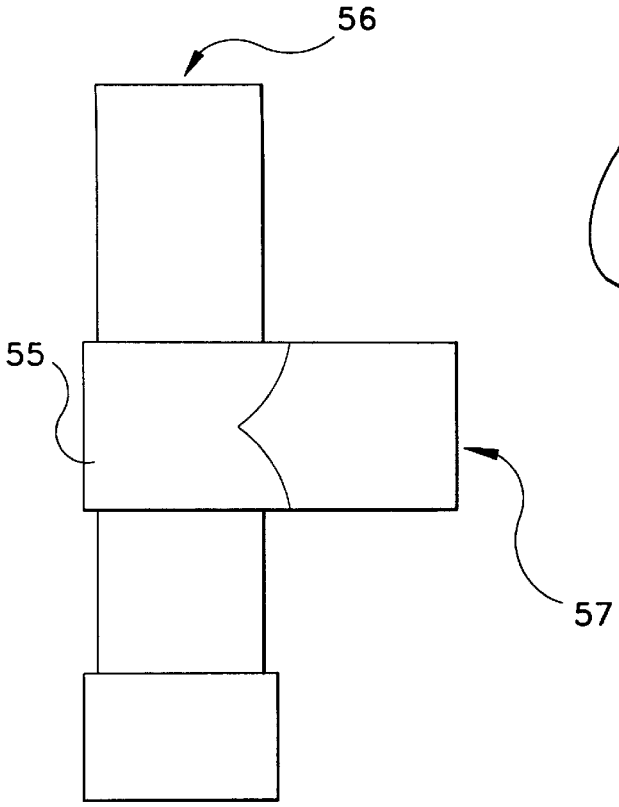
FIG. 8C is a side view of a T shaped connecting piece according to the present invention.
Figure 8A:
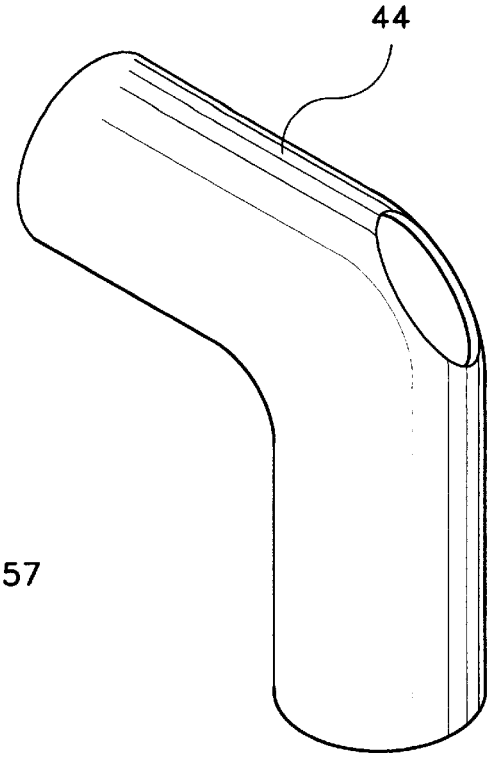
FIG. 8A is a perspective view of a corner connector piece according to the present invention.
Figure 8B:
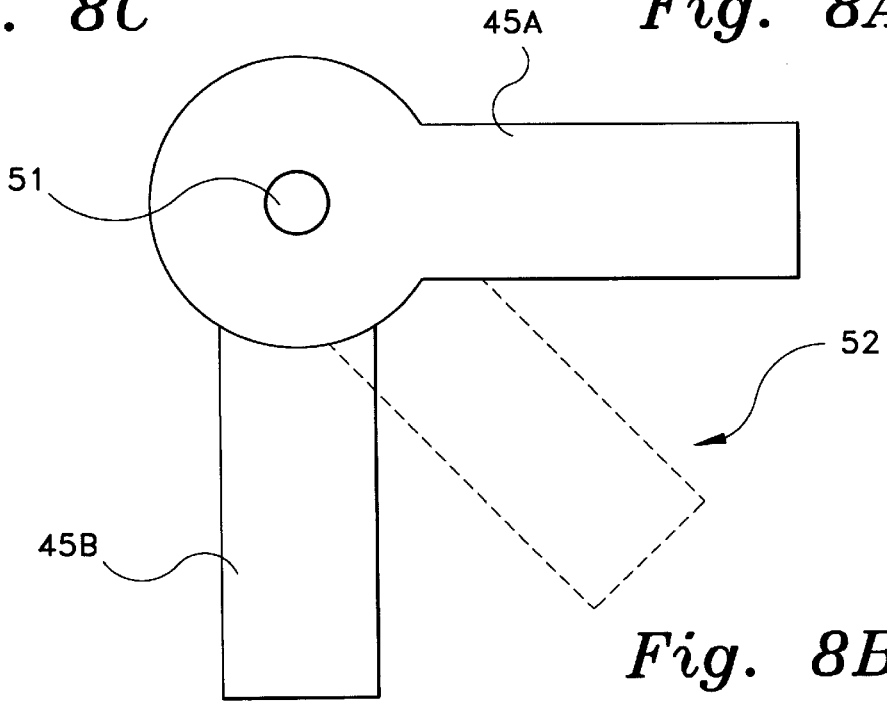
FIG. 8B is a side view of a pivotable corner connector piece according to the present invention.

FIGS. 8A and 8B show alternate embodiments of the corner connectors. In FIG. 8A the corner connector 44 has a bend equal to 90 degrees, whereas FIG. 8B shows a pivotable corner connector. The pivotable corner connector 52 has a pivot 51 about which the component parts 45*a*,45*b* of the connector 52 can be rotated. The pivotable corner connector 52 has a bend equal to 90 degrees when the connector 52 is part of an assembled beach chair 5. FIG. 8C shows a T shaped connecting piece 55 with multiple openings 56,57. A bar 18 is inserted into each opening of the T shaped connector 55 when needed. An inserted bar 18 inside an opening of the T shaped connector 55 can be rotated if necessary. One opening (hidden) of the T shaped connector depicted in FIG. 8C is capped.

The foldable beach chair of the present invention with its innovative design makes it easier for a person to transport a beach chair from one location to another location. The collapsible mechanism of the foldable beach chair of the present invention makes the chair easy to manually fold and carry. The unique compactness of the foldable beach chair of the present invention when folded allows the chair to be carried in a carrying case; therefore, carrying one or more chairs is easy and convenient. The foldable beach chair of the present invention is economical to manufacture because it requires a minimal number of parts. The component parts or frame members of the foldable beach chair of the present invention can be fabricated using any suitable material, for example, instead of PVC, either stainless steel or aluminum could be used.

It should be understood by those skilled in the art that various modifications and adaptations of the present invention as well as alternative embodiments of the present invention may be contemplated. The preferred embodiments of the present invention disclosed herein are intended to be illustrative only and are not intended to limit the scope of the invention. It is to be understood that the present invention is not limited to the sole embodiment described above, but encompasses any and all embodiments within the scope of the following claims.

What is claimed is:

1. A flexible foldable beach chair comprising:

a plurality of frame members comprising a backrest including opposing bars, an armrest, a seat, front legs, back legs including notches and linkages engageable with the notches; and a first, second and third string-tube-connector assembly, each comprising left and right tubes, a tubular connector having left and right ends, each for insertably receiving one of said left and right tubes, and a flexible string passing through said left and right tubes and said tubular connector for constraining the left and right tubes and connector as a single unit;

wherein said first string-tube-connector assembly is insertably attached to each of the bars of said backrest, said second string-tube-connector assembly is insertably attached to each of said front legs, and said third string-tube-connector assembly is insertably attached to each of said back legs of said chair;

wherein said string of each said first, second and third string-tube-connector assembly is constrained and respectively attached to each of the bars of said backrest, each of said front legs and each of said back legs of said chair by plugs, thereby defining a unitary support frame.

2. The flexible foldable beach chair according to claim 1, wherein:

said said bars, said armrest, said front legs and said back legs arms are made of PVC.

3. The flexible foldable beach chair according to claim 1, wherein:

said backrest and said seat include a nylon weave fabric.

4. The flexible foldable beach chair according to claim 1, wherein:

each of the bars of said backrest, each of said front and back legs define an aperture for the plugs removably attached within said aperture, said string of each said first, second and third string-tube-connector assembly being attached to the respective plugs, whereby said plugs prevent accumulation of foreign material within said tubes.

5. The flexible foldable beach chair according to claim 1 wherein:

said backrest is inclinably adjustable;

said back legs have an orientation selected from the group consisting of vertical or angled; and said front legs have an orientation selected from the group consisting of vertical or angled.

6. The flexible foldable beach chair according to claim 5, wherein:

each of the bars of said backrest has a bottom portion, and said linkages are pivotally attached to the bottom portion of each said bars.

7. The flexible foldable beach chair according to claim 6, wherein:

each of the bars of said backrest is L-shaped.

8. The flexible foldable beach chair according to claim 7, wherein:

said L-shaped bars are made of a material selected from the group consisting of PVC or metal.

9. The flexible foldable beach chair according to claim 1, wherein:

each said first, second and third string-bar-connector assembly is made of PVC.

* * * * *